US008587209B2

(12) United States Patent
Soleño

(10) Patent No.: US 8,587,209 B2
(45) Date of Patent: Nov. 19, 2013

(54) LED DRIVERS AND CONTROL METHODS

(75) Inventor: Antonio R. Soleño, Mandaluyong (PH)

(73) Assignee: Astec International Limited, Kwon Tong, Kowloon (HK)

( * ) Notice: Subject to any disclaimer, the term of this patent is extended or adjusted under 35 U.S.C. 154(b) by 427 days.

(21) Appl. No.: 12/962,143

(22) Filed: Dec. 7, 2010

(65) Prior Publication Data

US 2012/0139438 A1 Jun. 7, 2012

(51) Int. Cl.
*H05B 37/02* (2006.01)

(52) U.S. Cl.
USPC ..... 315/219; 315/206; 315/247; 315/308

(58) Field of Classification Search
USPC ..... 315/200 R, 206, 209 R, 219, 224, 225, 315/247, 291, 307, 308
See application file for complete search history.

(56) References Cited

U.S. PATENT DOCUMENTS

| | | | | |
|---|---|---|---|---|
| 6,888,383 | B1 | 5/2005 | Fairbanks | |
| 7,538,534 | B2 | 5/2009 | Mednik et al. | |
| 7,750,616 | B2 * | 7/2010 | Liu | 323/285 |
| 2005/0151518 | A1 | 7/2005 | Schneiker et al. | |
| 2010/0207536 | A1 * | 8/2010 | Burdalski et al. | 315/224 |
| 2011/0266969 | A1 * | 11/2011 | Ludorf | 315/294 |
| 2012/0112648 | A1 * | 5/2012 | Hariharan | 315/186 |

FOREIGN PATENT DOCUMENTS

| | | |
|---|---|---|
| JP | 2009-099894 | 5/2009 |
| WO | 95-23452 | 8/1995 |
| WO | 2005-011097 | 2/2005 |
| WO | 2007-132345 | 11/2007 |

OTHER PUBLICATIONS

"New constant power LED driver architecture reduces the cost for offline LED Ballasts", Iain Mosely, www.ledsmagazine.com, Apr. 2008, pp. 44-46.

* cited by examiner

*Primary Examiner* — Thuy Vinh Tran
(74) *Attorney, Agent, or Firm* — Harness, Dickey & Pierce, P.L.C.

(57) ABSTRACT

A method of operating an LED driver including a power converter to generate an output current for powering an LED and to provide active power factor correction is disclosed. The power converter is coupled between an input to receive a rectified AC voltage and an output for providing the output current to the LED. The method includes operating the power converter at a substantially fixed frequency in an open loop mode based on a current through the inductive element and the rectified AC voltage. LED drivers operable in accordance with the disclosed method are disclosed.

19 Claims, 10 Drawing Sheets

LED DRIVERS AND CONTROL METHODS

FIELD

The present disclosure relates to light emitting diode (LED) drivers and control methods.

BACKGROUND

This section provides background information related to the present disclosure which is not necessarily prior art.

Providing lighting using LEDs typically requires the use of a driver to provide the proper voltage and current to permit the LEDs to operate properly and safely. Some LED drivers convert rectified AC voltages to the proper voltage and current to operate the LEDs. Many of such LED drivers use isolated power converter topologies including, e.g., flyback converters. Typically, the isolated converter based drivers operate in a closed loop, constant current mode. The output current of an isolated converter is sensed on the secondary side of the transformer and is often provided to the controller, which is located on the primary side of the transformer, via an optocoupler. Some known designs include passive power factor correction (PFC), while others include an active PFC circuit.

SUMMARY

This section provides a general summary of the disclosure, and is not a comprehensive disclosure of its full scope or all of its features.

According to one aspect of the present disclosure, a method of operating an LED driver including a power converter to generate an output current for powering an LED and to provide active power factor correction is disclosed. The power converter is coupled between an input to receive a rectified AC voltage and an output for providing the output current to the LED. The method includes operating the power converter at a substantially fixed frequency in an open loop mode based on a current through the inductive element and the rectified AC voltage.

According to another aspect of this disclosure, an LED driver includes an input for receiving a rectified AC voltage, an output for providing an output current, a power converter coupled between the input and the output to receive the rectified AC voltage and generate the output current, and a controller for controlling the power converter at a substantially constant frequency to provide the output current and active power factor correction. The power converter includes a switch and an inductive element. The switch is coupled to the inductive element. The controller is configured to control an on time of the switch as a function of a current through the inductive element and the rectified AC voltage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 8:
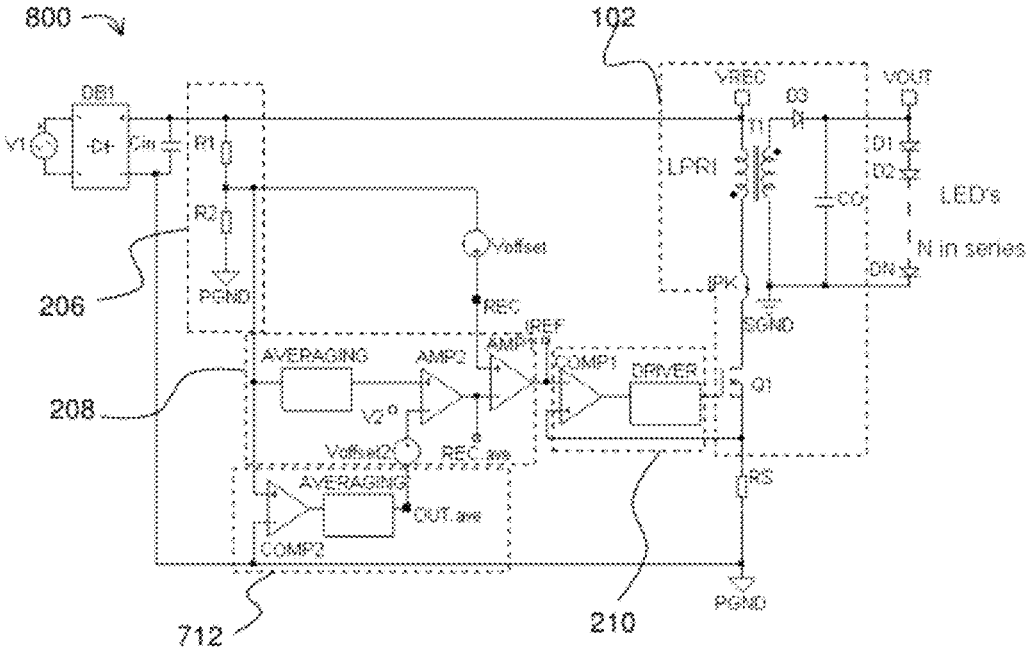
FIG. 8 is a schematic diagram of another example LED driver according to the present disclosure including a phase cut detector.
Figure 9:
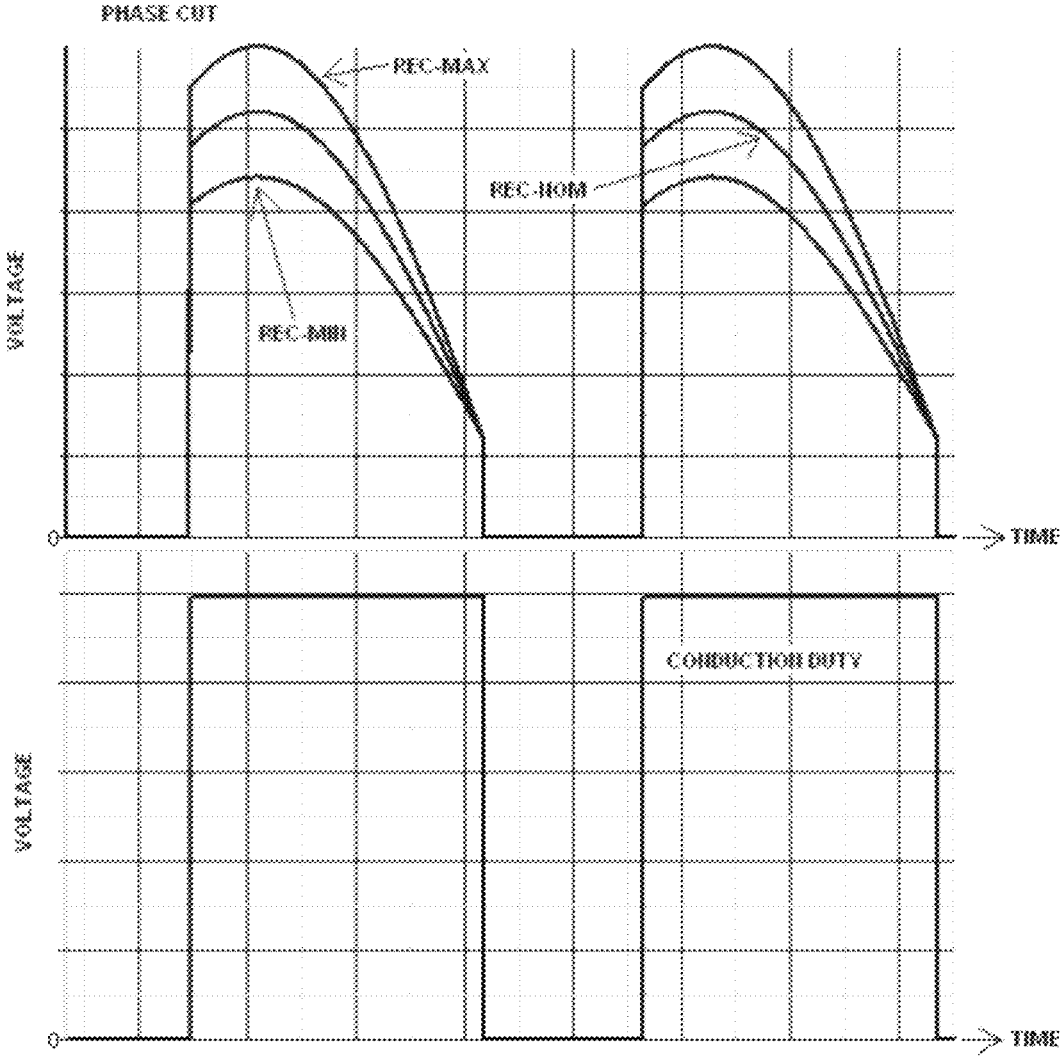

FIG. 9. is a graph of example phase cut AC signals and a square wave signal generated from the example signals by the LED driver of FIG. 8.

Figure 10:
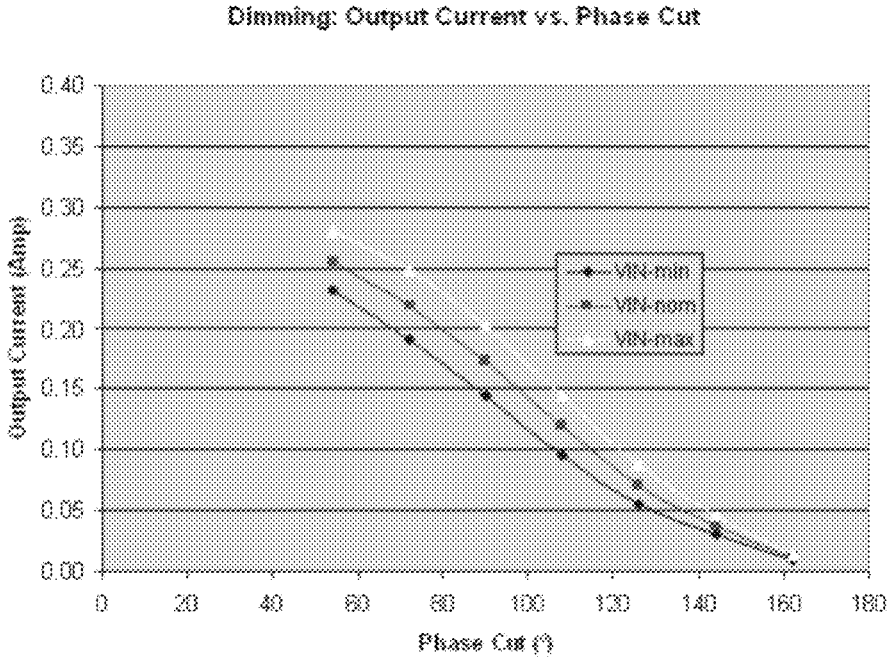

FIG. 10 is a graph of output current as a function of phase cut angle for the LED driver of FIG. 8.

Figure 11:
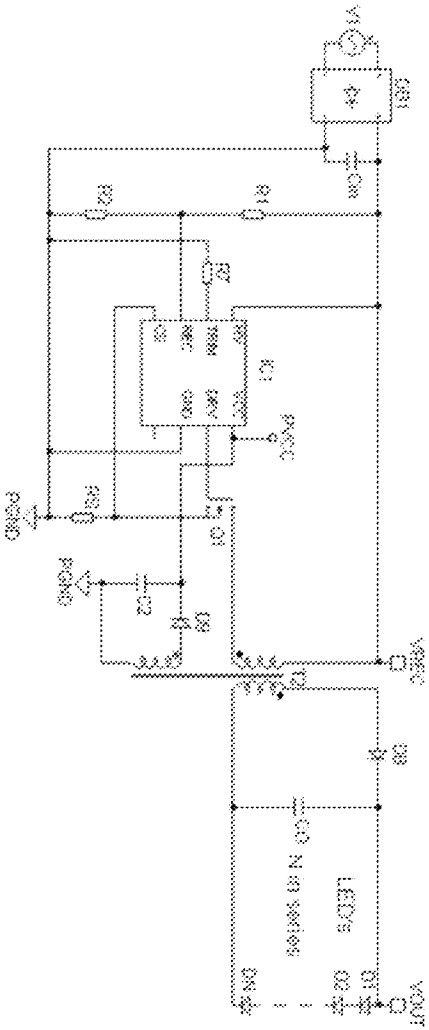

FIG. 11 is an application schematic of another example LED driver according to the present disclosure.

Figure 12:
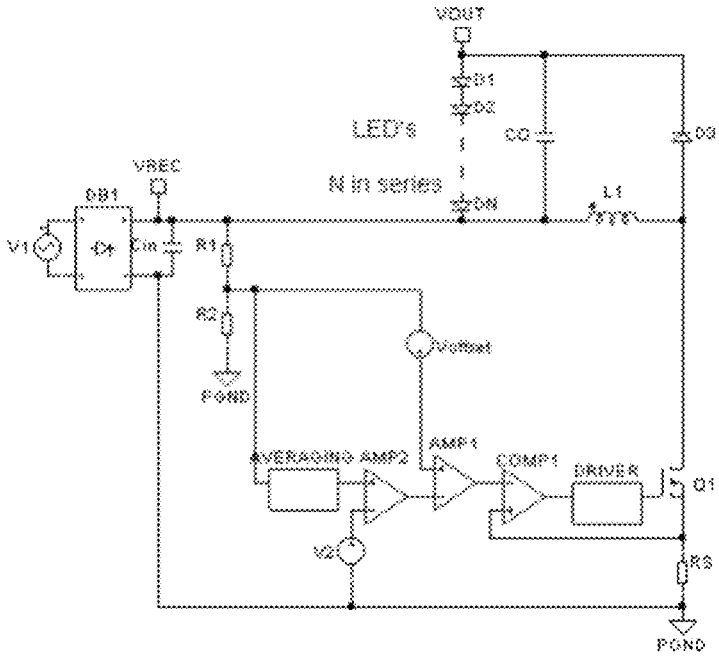

FIG. 12 is a schematic diagram of an example LED driver according to the present disclosure including a buck-boost converter with its output referenced to the input voltage.

Figure 13:
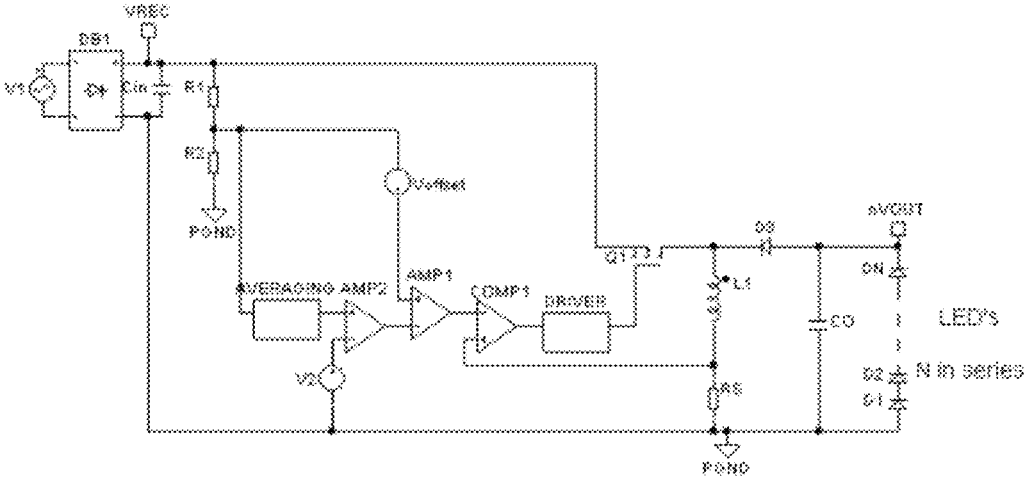

FIG. 13 is a schematic diagram of an example LED driver according to the present disclosure including an inverting buck-boost converter.

Figure 14:
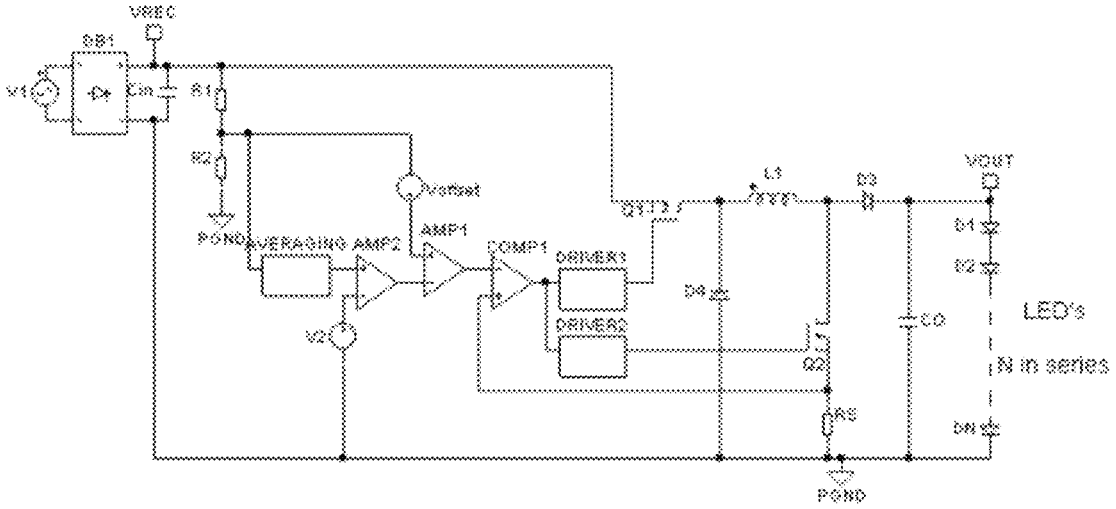

FIG. 14 is a schematic diagram of an example LED driver according to the present disclosure including a non-inverting buck-boost converter utilizing two switches.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

According to one aspect of the present disclosure, a method of operating an LED driver including a power converter to generate an output current for powering an LED and to provide active power factor correction is disclosed. The power converter is coupled between an input to receive a rectified AC voltage and an output for providing the output current to the LED. The method includes operating the power converter at a substantially fixed frequency in an open loop mode based on a current through an inductive element and the rectified AC voltage.

Example LED drivers suitable for performing this method will be discussed below. It should be understood that this disclosure is not limited to the example LED drivers and that other LED drivers may be operated according to the method disclosed herein.

Figure 1:
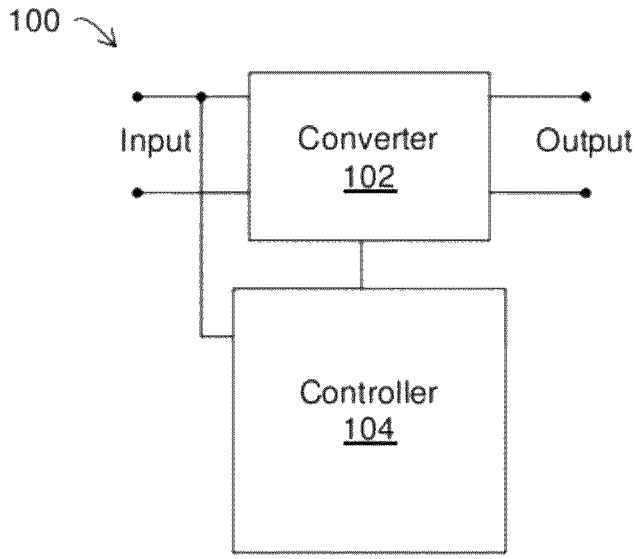
FIG. 1 is a block diagram of an example LED driver according to the present disclosure.

FIG. 1 is a block diagram of an example LED driver, generally indicated by reference numeral 100, according to the present disclosure. The LED driver 100 includes an input for receiving a rectified AC voltage as an input voltage. A power converter 102 is connected to the input to receive the input voltage and output an output current. A controller 104 controls operation of the power converter 102 to provide the output current and power factor correction. The controller 104 controls the power converter 102 at a substantially constant frequency. The controller 104 is configured to control the on time of a switch of the power converter 102 as a function of the current through an inductive element of the power converter 102 and the rectified AC voltage.

The power converter 102 may be an isolated or non-isolated power converter. If the converter 102 is an isolated converter, the inductive element may be the primary winding of a transformer. If the converter is a non-isolated converter, the inductive element is may be an inductor. Of course, any other suitable inductive element may be used. The power converter 102 may be any suitable power converter topology. For example, the power converter 102 may be a flyback converter, a buck converter, a boost converter, a buck-boost converter, etc.

Figure 2:
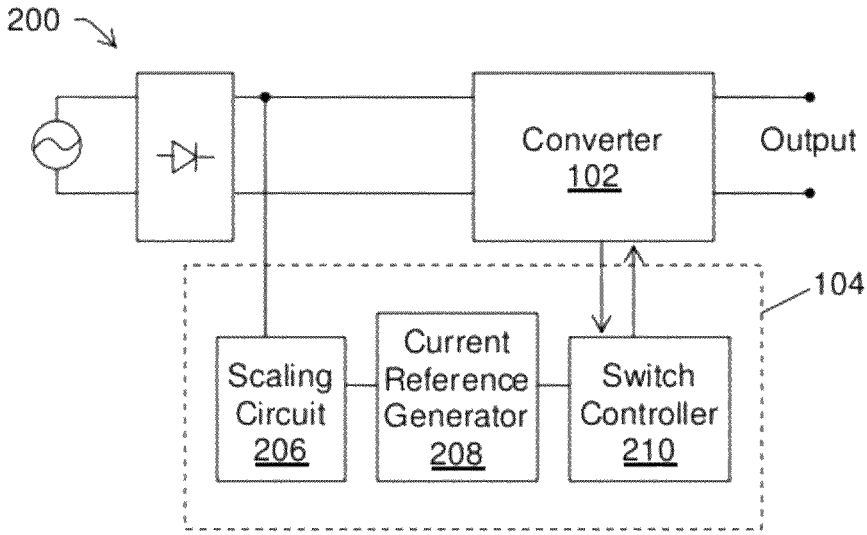
FIG. 2 is a block diagram of another example LED driver according to the present disclosure coupled to an AC power source and a bridge rectifier.

Example LED driver 200 in FIG. 2 includes a block diagram of one suitable controller 104 for controlling operation of the power converter 102. The controller 104 includes a scaling circuit 206 connected to the input to generate a scaled input voltage from a rectified AC input voltage. The scaled input voltage is provided to a current reference generator 208 that generates a current reference as a function of the scaled input voltage. The current reference is input to a switch controller 210. The switch controller 210 controls a switch in the converter 102 based on the current reference and a signal representative of the current through an inductive element of the converter 102. The current reference closely tracks the shape of the rectified AC input voltage. Relatively high power factor may be achieved, at least in part, because of the close relationship of the current reference to the shape of the rectified AC input voltage.

Figure 3:
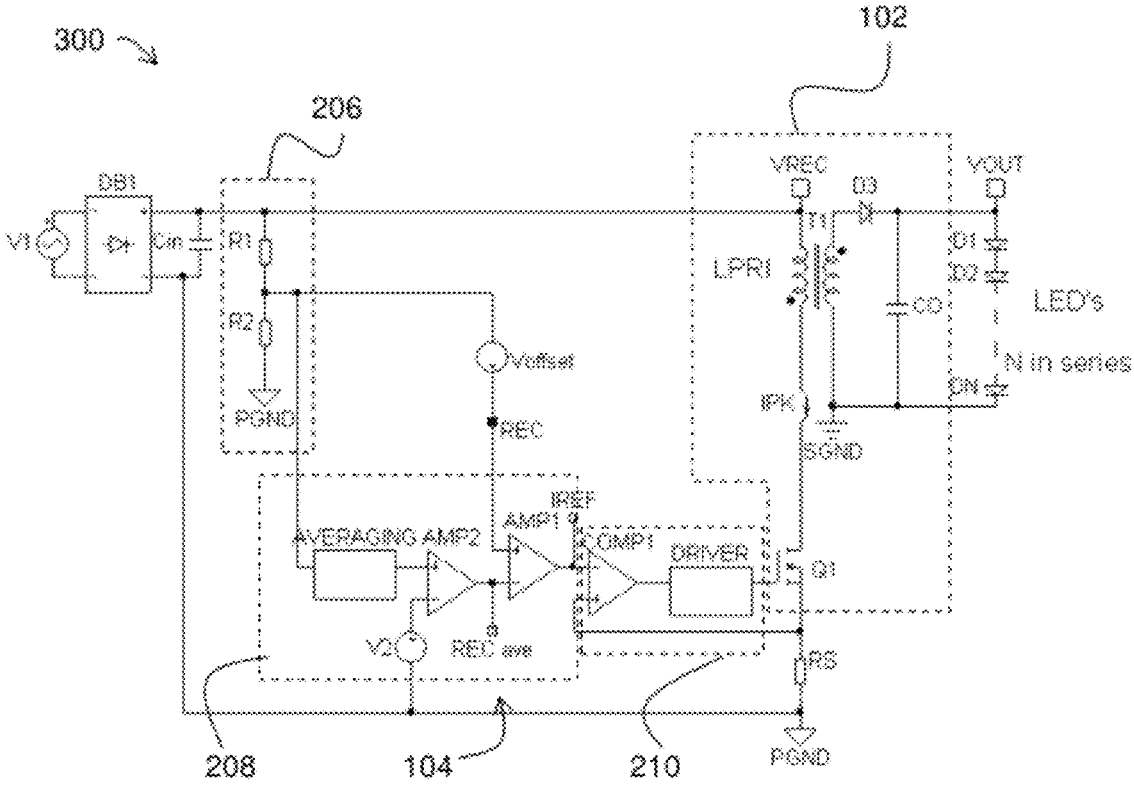
FIG. 3 is a schematic diagram of another example LED driver according to the present disclosure coupled to an AC power source and a string of LEDs.

The LED driver 300 in FIG. 3 illustrates one example construction of the LED driver 200. The LED driver 300 includes an input for receiving a rectified AC voltage as an input voltage. The power converter 102 is connected to the input to receive the input voltage and output an output current. The converter 102 includes a switch Q1 and a transformer T1. The transformer T1 includes a primary winding having a primary inductance $L_{PRI}$ connected to the switch Q1. The controller 104 controls operation of the power converter 102 to generate the output current and provide active power factor correction. The controller 104 includes the scaling circuit 206 connected to the input to generate a scaled input voltage. The scaled input voltage is provided to the current reference generator 208 that generates a current reference $I_{REF}$ as a function of the scaled input voltage. The current reference is input to the switch controller 210. The switch controller 210 controls the switch Q1 based on the current reference $I_{REF}$ and a signal representative of the current $I_{PK}$ through the primary winding $I_{PRI}$.

As explained below, the current reference $I_{REF}$ closely tracks the shape of the rectified AC voltage. This close tracking permits the controller 104 to operate the power converter 102 to achieve a relatively high power factor.

Generally, the LED driver 300 maintains a substantially constant output current at varying input voltages in a fixed frequency, discontinuous current mode (DCM) operation. The substantially constant current is achieved in open loop by adjusting the on-time ($T_{ON}$) of the switch Q1. $T_{ON}$ is a function of inductor peak current $I_{PK}$, inductance and input voltage. When the converter 102 is operating at a minimum input voltage, $I_{REF}$ is derived from the rectified input voltage plus a defined offset voltage $V_{OFFSET}$. When the input voltage changes and the converter 102 is operating above the minimum input voltage, the magnitude of $V_{OFFSET}$ is less than the value at the minimum input voltage. When the input voltage is, for example, midway between the minimum input voltage and the maximum input voltage, the magnitude of $V_{OFFSET}$ is half its value at the minimum input voltage. When the converter is operating at maximum input voltage, $V_{OFFSET}$ is totally removed and $I_{REF}$ is derived from the rectified input voltage. The use of $V_{OFFSET}$ permits the driver 300 to provide a substantially constant output power. To achieve a substantially constant output current, the RMS value of $I_{REF}$ is maintained substantially constant throughout the operating input voltage range.

The power converter 102 in the example LED driver 300 is a flyback converter. For a flyback converter, and other isolated AC-DC converters that may be used in LED driver 300, the control of output current is achieved on the primary side of the transformer T1. Accordingly, the LED driver 300 does not utilize an optocoupler to transfer signals from the secondary side of the transformer T1 to the primary side.

The converter 102 operates at fixed frequency, discontinuous conduction mode (DCM). The power in the flyback choke is $$P_{OUT} = \frac{1}{2} L_{PRI} \times I_{PK}^2 \times F_{SW} \tag{1}$$

$F_{SW}$ is the switching frequency of the LED driver 300. The peak current $I_{PK}$ through the primary winding is $$I_{PK} = \frac{V_{ON} \times T_{ON}}{L_{PRI}} \tag{2}$$

$V_{ON}$ is equivalent to the rectified AC voltage $V_{REC}$. Substituting equation 2 into equation 1 yields $$P_{OUT} = \frac{V_{REC.RMS}^2 \times T_{ON}^2}{2 \times L_{PRI}} \times F_{SW} \tag{3}$$

Because $L_{PRI}$ & $F_{SW}$ are fixed values, in order to maintain $P_{OUT}$ substantially constant when the input voltage changes, $T_{ON}$ must be adjusted. $T_{ON}$ is determined by:

$$T_{ON} = \frac{I_{PK} \times L_{PRI}}{V_{REC.RMS}} \tag{4}$$

In LED driver 300, the peak current $I_{PK}$ through the primary winding of transformer T1 may be given by:

$$I_{PK} = \frac{I_{REF}}{R_S} \tag{5}$$

Combining equations 4 and 5 yields:

$$T_{ON} = \frac{I_{REF} \times L_{PRI}}{R_S \times V_{REC.RMS}} \tag{6}$$

In equation 6, $L_{PRI}$ and $R_S$ are fixed values and $V_{REC.RMS}$ is the RMS value of the rectified input voltage. Accordingly, $T_{ON}$ can be adjusted by varying the current reference $I_{REF}$. $I_{REF}$ is the current reference voltage going to the inverting pin (INV) of PWM comparator COMP1.

The current reference $I_{REF}$ is varied by changing AMP2's output (REC.ave). Generally, REC.ave corresponds to the percentage the input voltage deviates from a minimum operating voltage. More particularly, $I_{REF}$ and REC.ave are determined by:

$$I_{REF} = V_{REC.RMS} \times \frac{R2}{R1 + R2} + V_{OFFSET} - REC.ave \tag{7}$$

$$REC.ave = \Delta V_{IN} \times V_{REC.MIN.RMS} \times \frac{R2}{R1 + R2} \tag{8}$$

The scaling circuit 206 scales down the rectified AC input voltage, $V_{REC}$, with a divider network of R1 & R2. A fixed DC voltage offset, $V_{OFFSET}$, is added to the scaled voltage and the resulting scaled and offset voltage is fed into the non-inverting pin (NINV) of differential amplifier AMP1 (also sometimes referred to as node REC).

The averaging block of the current reference generator 208 receives the scaled rectified AC input (without the fixed DC voltage offset $V_{OFFSET}$). The averaging block outputs a DC voltage representative of the average of the scaled down rectified AC voltage to the non-inverting pin of differential amplifier AMP2. The inverting pin of AMP2 receives a reference voltage V2. In this embodiment, the reference voltage V2 is set equal to the DC voltage representative of the average of the scaled down rectified AC voltage (i.e., the output of the averaging block) when the rectified AC input is at the minimum operating voltage. Based on these inputs, amplifier AMP2 outputs a DC voltage REC.ave as defined by equation 8 to the inverting pin of amplifier AMP1.

Figure 4:
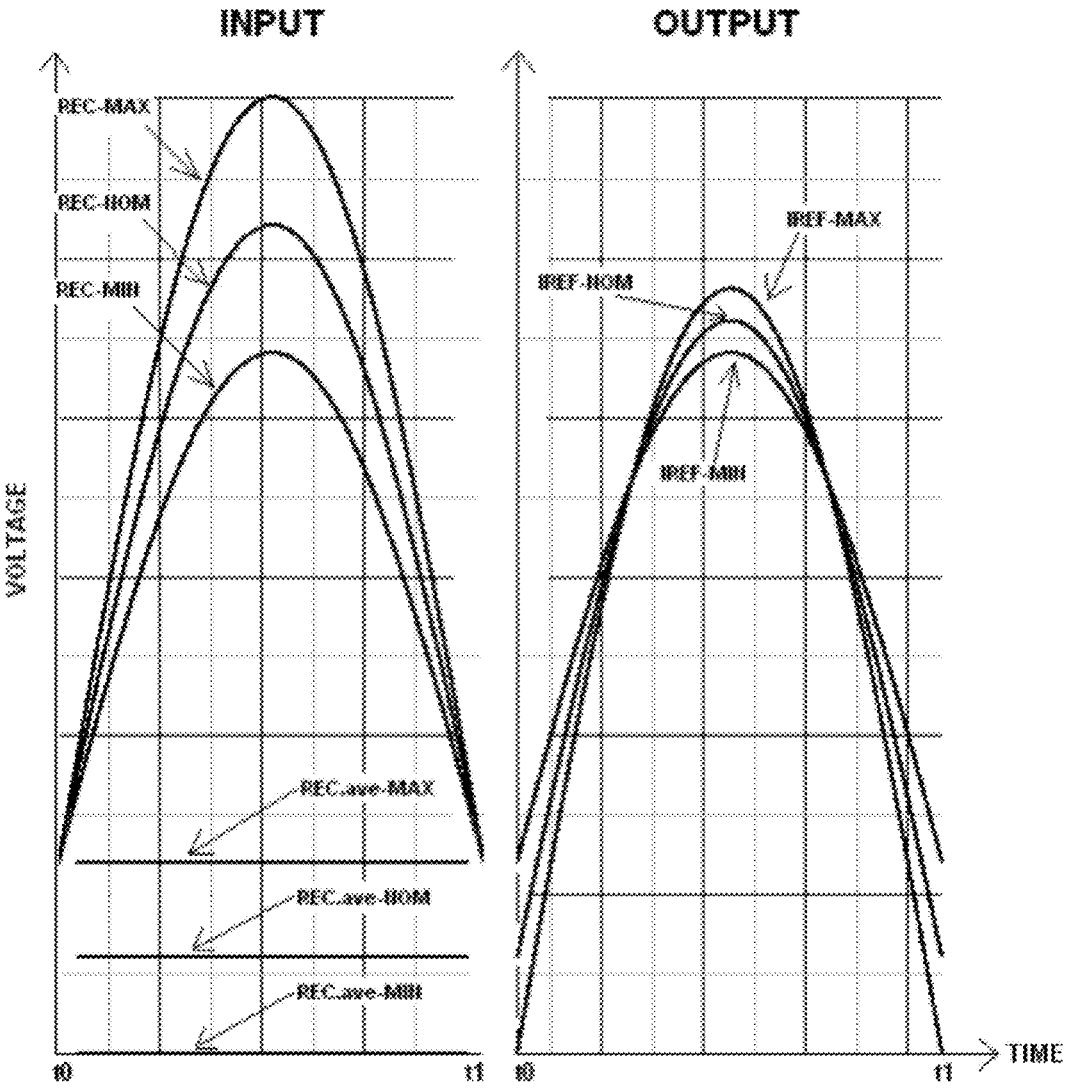
FIG. 4 is graph of example inputs and output of AMP1 of the LED driver of FIG. 3.

In FIG. 4, the left graph illustrates the waveforms REC_MIN, REC_NOM and REC_MAX, corresponding to the minimum, nominal and maximum values of the offset, scaled and rectified AC voltage (REC) input to the non-inverting pin of AMP1. Also illustrated in the left graph are REC.ave_MIN, REC.ave_NOM and REC.ave_MAX, corresponding to the minimum, nominal and maximum values of the REC.ave input to the inverting pin of AMP1. The output of AMP1, i.e. the current reference $I_{REF}$, is shown in the right graph for the inputs shown in the left graph.

FIG. 4 illustrates how $I_{REF}$ varies as input voltage V1 varies. In general, $I_{REF}$ is equal to the rectified scaled AC input voltage REC plus $V_{OFFSET}$. As the input voltage increases from a minimum, the combination of the averaging block, AMP2, and AMP1 remove a portion of $V_{OFFSET}$ from $I_{REF}$. When the input voltage V1 is at a maximum, all of $V_{OFFSET}$ is removed from $I_{REF}$ and $I_{REF}$ is substantially identical to the scaled rectified AC input voltage (i.e., the output of the scaling circuit 206). This may also be viewed as adjusting $I_{REF}$ as a function of the scaled rectified AC input voltage and a variable offset. The value of $V_{OFFSET}$ is set by:

$$V_{OFFSET} = \left( \sqrt{VREC_{MAX.RMS}^2 - VREC_{MIN.RMS.AC}^2} - VREC_{MIN.RMS.DC} \right) \times \frac{R2}{R1 + R2} \tag{9}$$

If the input voltage V1 is at a minimum (V1min), the output of AMP2 is substantially zero. As a result, REC.ave is zero and $V_{OFFSET}$ is not removed from REC by AMP1. Accordingly, $I_{REF}$ is equal to REC when the rectified AC input voltage is at the minimum. To maintain a generally constant output current at a different input voltage, $I_{REF}$ is adjusted to reduce the input current of the converter 102. The non-inverting input of AMP2 is equivalent to the scaled-down average voltage of VREC. When V1 is at a maximum (V1max), the voltage at the non-inverting input of AMP2 is equal to [(V1max/V1min)×V2]. V2 is set at a fixed DC voltage equivalent to twice $V_{OFFSET}$. When at V1max, the differential voltage at the output of AMP2, which is REC.ave, is equivalent to the voltage of $V_{OFFSET}$. Referring to FIG. 4, this can be represented by:

$$REC_MAX - REC \cdot ave_MAX = IREF_MAX \tag{10}$$

IREF_MAX is substantially identical to the rectified input voltage. As a result, relatively high power factor correction may be obtained at maximum input voltage.

High line (e.g., 240 VAC) and low line (e.g., 120 VAC) versions of the LED driver 300 have been constructed and tested. In the high line test driver, Cin was 100 nF, R1 was 440 kΩ, R2 was 1.1 kΩ, RS was 0.47Ω, CO was 940 μF, Lpri was 700 μH, $V_{OFFSET}$ was 0.235V and V2 was 0.47V. In the low line test driver, R2 was 2.2 kΩ, RS was 0.33Ω, $V_{OFFSET}$ was 0.234V and V2 was 0.468V. The remaining components were of the same value as in the high line test driver. The high line and low line test circuits were used to power a string of six LEDs connected in series. The results of the tests are shown in FIGS. 5 and 6.

Figure 5:
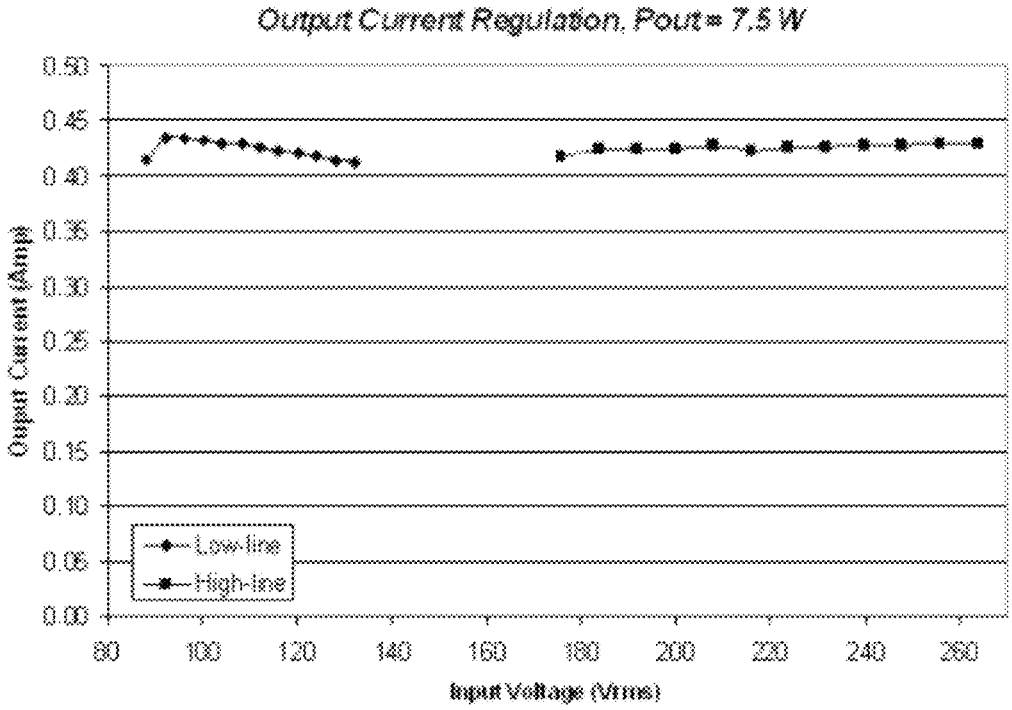
FIG. 5 is a graph of output current as a function of input voltage for the LED driver of FIG. 3.
Figure 6:
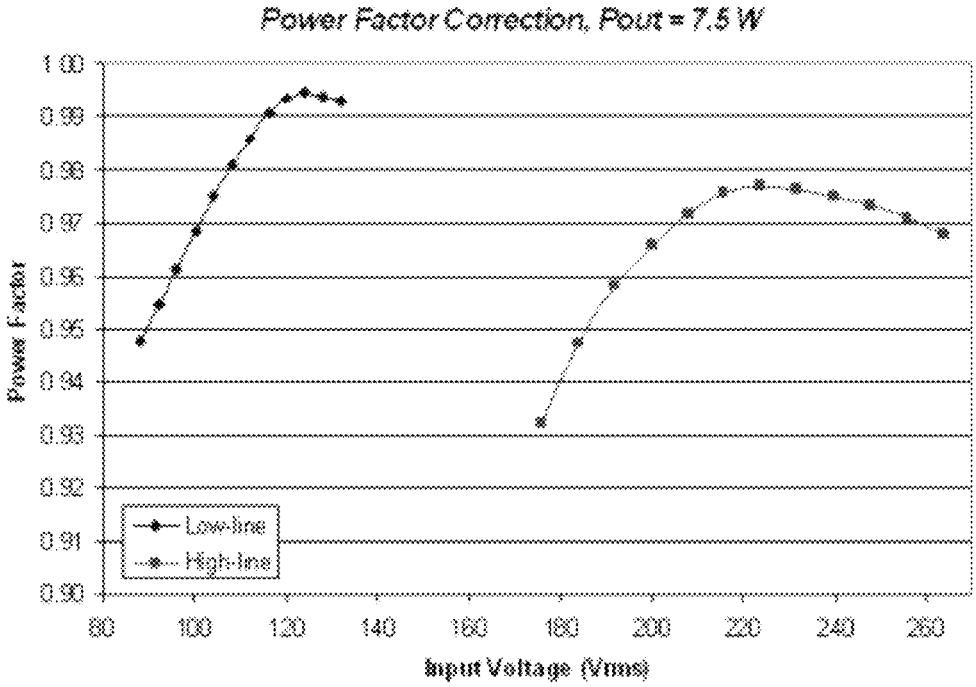
FIG. 6 is a graph of power factor as a function of input voltage for the LED driver of FIG. 3.

FIG. 5 graphs the output current regulation versus the AC input voltage for the LED driver 300 operating at 7.5 watts output power. In FIG. 6, the power factor for LED driver 300 operating at 7.5 watts output power is graphed as a function of the AC input voltage.

In some applications it may be desirable to control the amount of light emitted by an LED controlled by an LED driver according to the present disclosure. A dimming signal may be generated by, for example, a phase cut dimmer such as a traditional wall dimmer. A phase cut dimmer is operable to cut off a portion of an AC voltage waveform. Phase cut dimmers may cut off the front-end of an AC half cycle or the back-end of the AC half cycle. A phase cut dimmer may cut off various amounts of the AC voltage to produce various dimming levels. The amount of the AC voltage cut off by the phase cut dimmer is referenced by the phase cut angle. The phase cut angle may generally be any angle between zero and one hundred and eighty degrees, commonly representing no dimming/cutting (full power) and fully dimmed/cut (no power) respectively.

Figure 7:
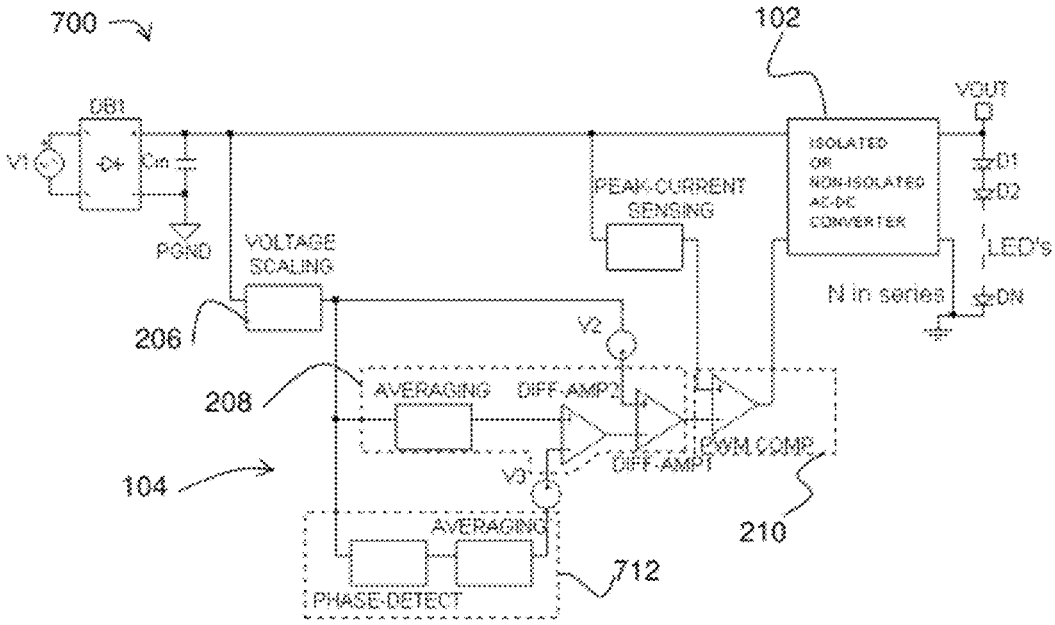
FIG. 7 is a schematic diagram of an example LED driver according to the present disclosure including a phase cut detector.

LED driver 700 in FIG. 7 is an example embodiment of the LED driver 200 that may be operated with an input voltage that may be phase cut. LED driver 700 includes an input for receiving a rectified AC voltage as an input voltage. The power converter 102 is connected to the input to receive the input voltage and output an output current. The controller 104 controls operation of the power converter 102. The controller 104 includes the scaling circuit 206 connected to the input to generate a scaled input voltage. The scaled input voltage is provided to the current reference generator 208 that generates the current reference $I_{REF}$. The current reference $I_{REF}$ is input to the switch controller 210. The switch controller 210 controls the converter 102 based on the current reference $I_{REF}$ and a signal representative of the current $I_{PK}$ through an inductive element of the converter 102.

The LED driver 700 also includes a phase cut detector 712. The phase cut detector 712 detects a phase cut angle of the rectified AC input voltage and provides a signal representative of the phase cut angle to the current reference generator 208. The current reference $I_{REF}$ is based on, or sometimes stated as a function of, the scaled input voltage and the signal representative of the phase cut angle. Accordingly, the LED driver 700 is operable with an AC input voltage that is controlled by, for example, a phase cut dimmer.

LED driver 800 includes an example construction of the phase cut detector 712. In other respects, LED driver 800 is similar to the LED driver 300 in FIG. 3. LED driver 800 includes an input for receiving a rectified AC voltage as an input voltage. The power converter 102 is connected to the input to receive the input voltage and output an output current. The converter 102 includes the transformer T1 with a primary winding connected to the switch Q1. The controller 104 controls operation of the power converter 102 by controlling the switch Q1. The controller 104 includes the scaling circuit 206 connected to the input to generate a scaled input voltage. The scaled input voltage is provided to the current reference generator 208 that generates a current reference $I_{REF}$. The current reference $I_{REF}$ is input to the switch controller 210. The switch controller 210 controls the switch Q1 based on the current reference $I_{REF}$ and a signal representative of the current $I_{PK}$ through the primary winding of the transformer T1. The LED driver 800 also includes the phase cut detector 712. Accordingly, the LED driver 800 is operable with an AC input voltage that is controlled, for example, by a phase cut dimmer.

The LED driver 800 generally operates in the same manner as the LED driver 300 discussed above. When the AC input voltage is not phase cut, e.g., when there is no phase cutting dimmer coupled to the LED driver 800 or when a phase cut dimmer is connected, but set at full power (no cutting), the inverting input of AMP2, voltage V2, is a fixed DC voltage. When the AC input voltage is phase cut, e.g. when a phase cut dimmer is set below full power and it phase cuts the AC input voltage, V2 decreases in a non-linear fashion with respect to the conduction angle.

The top graph of FIG. 9 shows the voltage REC for a minimum, a maximum and a nominal AC input voltage when the AC voltage has been phase cut. The rectified phase cut AC input voltage is input to the non-inverting pin of a comparator COMP2 of the phase cut detector 712. The bottom graph in FIG. 9 illustrates the output of the comparator COMP2 for the example inputs in the top graph. As can be seen, the output of COMP2 is a PWM signal that will vary with the angle of the phase cut. The duty cycle is derived from the phase conduction, $D_{COND}$. This PWM signal is averaged by an averaging block and output as OUT.ave by the phase cut detector. The voltage OUT.ave is offset by a fixed voltage Voffset2 resulting in a voltage V2 applied to the inverting pin of AMP2. The voltage V2 is described by:

$$V2=\text{OUT}\cdot\text{ave}\times D_{COND}-V\text{offset2} \tag{10}$$

The addition of the offset voltage Voffset2 causes voltage V2 to vary nonlinearly with respect to changes in the phase cut angle of the AC input voltage. Voltage V2 is generally used in the same way and for the same purposes as the voltage V2 in the LED driver 300 in FIG. 3. However, voltage V2 in driver 800 is not a fixed voltage. Instead, it varies, nonlinearly, as a function of the phase cut angle of the AC input voltage. This results in a decrease in output current as the phase cut angle increases as shown in FIG. 10. FIG. 10 illustrates test results from computer simulations of the LED driver 800 that have been confirmed with tests on an actual circuit. For the simulation and the actual circuit, the LED driver 800 used a Voffset2 of 0.6V, with the remaining components having the same values as listed above for the test driver based on LED driver 300.

FIG. 11 is an application schematic of an example LED driver 1100. The LED driver 1100 incorporates the control circuitry of the LED drivers discussed above within an integrated circuit IC1.

FIGS. 12-14 illustrate additional example LED drivers according to aspects of the present disclosure. These LED drivers are controlled in the same or similar manner to the control of the LED drivers 300 and 800 discussed above. However, while LED drivers 300 and 800 both included power converters having a flyback topology, the LED drivers in FIGS. 12-14 have power converters with different, and non-isolated, topologies. In FIG. 12, the power converter is a buck-boost converter with its output voltage referenced to its input voltage. The power converter in FIG. 13 is an inverting buck-boost converter. FIG. 14 includes a non-inverting buck-boost converter utilizing two switches.

The LED drivers and the control methods described herein may permit operation at relatively high power factors. In an example embodiment, the power factor achieved is greater than 0.7. In another embodiment, an LED driver achieves a power factor greater than 0.9. As shown, for example, in FIG. 6, in some embodiments, LED drivers according to this disclosure may achieve a power factor greater than 0.93. In at least one embodiment, an LED driver achieves a power factor of about 0.9943 with a low line (e.g., 120 VAC) input.

The LED drivers disclosed herein may include analog components, digital components, and/or a combination of analog and digital components. The controllers disclosed and described herein may be discrete controllers or may be a combination of components, circuits, etc. that function as a controller. The controller components identified herein may be discrete components, embodied in integrated circuits, function blocks of a digital controller, etc.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An LED driver comprising:

an input for receiving a rectified AC voltage;

an output for providing an output current;

a power converter coupled between the input and the output to receive the rectified AC voltage and generate the output current, the power converter including a switch and an inductive element, the switch coupled to the inductive element; and a controller for controlling the power converter at a substantially constant frequency to provide the output current and active power factor correction, the controller configured to control an on time of the switch as a function of a current through the inductive element and the rectified AC voltage, and to compare a signal representative of the current through the inductive element with a current reference based, at least in part, on the rectified AC voltage to control the switch, the current reference derived from the rectified AC voltage and a variable offset.

2. The LED driver of claim 1 wherein a magnitude of the variable offset is a function of an average voltage of the rectified AC voltage.

3. The LED driver of claim 1 wherein the power converter is configured to operate between and including a maximum and a minimum rectified AC voltage and wherein the variable offset is substantially zero offset when the rectified AC voltage is at the maximum.

4. The LED driver of claim 3 wherein the current reference is substantially identical to the rectified AC voltage when the rectified AC voltage is at the maximum.

5. The LED driver of claim 1 wherein a magnitude of the variable offset is a function of an average voltage of the rectified AC voltage and a phase cut angle of the rectified AC voltage.

6. The LED driver of claim 5 further comprising a phase cut detector to detect the phase cut angle of the rectified AC voltage.

7. The LED driver of claim 6 wherein the magnitude of the variable offset varies nonlinearly with changes in the phase cut angle of the rectified AC voltage.

8. The LED driver of claim 1 wherein the power converter is a non-isolated power converter and the inductive element is an inductor.

9. The LED driver of claim 1 wherein the power converter is an isolated power converter and the inductive element is a primary winding of a transformer.

10. A method of operating an LED driver including a power converter to generate an output current for powering an LED and to provide active power factor correction, the power converter coupled between an input to receive a rectified AC voltage and an output for providing the output current to the LED, the method comprising operating the power converter at a substantially fixed frequency in an open loop mode based on a current through the inductive element and the rectified AC voltage, including comparing a signal representative of the current through the inductive element with a current reference based on the rectified AC voltage and a variable offset.

11. The method of claim 10 further comprising varying the variable offset as a function of an average voltage of the rectified AC voltage.

12. The method of claim 10 further comprising varying the variable offset as a function of an average voltage of the rectified AC voltage and a phase cut angle of the rectified AC voltage.

13. The method of claim 10 wherein operating the power converter includes operating the power converter in a discontinuous conduction mode.

14. An LED driver comprising:

an input for receiving a rectified AC voltage as an input voltage;

a power converter connected to the input to receive the input voltage and output an output current, the power converter including an inductive element coupled to the input and a switch coupled to the inductive element; and a controller for controlling operation of the power converter to generate the output current and provide active power factor correction, the controller including:

a scaling circuit connected to the input to generate a scaled input voltage;

a current reference generator connected to the scaling circuit to generate a current reference as a function of the scaled input voltage, the current reference generator including an averaging circuit connected to the scaling circuit to generate an average of the scaled input voltage, a first differential amplifier to receive the average of the scaled input voltage at a first input and a first offset voltage at a second input, a second differential amplifier to receive the output of the first differential amplifier at a first input and the scaled input voltage and a second offset voltage at a second input to generate the current reference; and a switch controller to control the switch based on the current reference and a signal representative of the current through the inductive element.

15. The LED driver of claim 14 wherein the switch controller includes a comparator connected to the scaling circuit to compare the current reference with the signal representative of the current through the inductive element, a driver connected to the comparator to receive the output of the comparator and control the switch.

16. The LED driver of claim 15 further comprising a phase cut detector connected to the scaled input voltage to detect a phase cut angle of the rectified AC voltage, the phase cut detector connected to the first differential amplifier to provide the first offset voltage.

17. The LED driver of claim 15 wherein the first offset voltage is a fixed DC voltage.

18. The LED driver of claim 1 wherein the controller is configured to operate in a discontinuous conduction mode.

19. The LED driver of claim 14 wherein the controller is configured to operate in a discontinuous conduction mode.

* * * * *